US010811759B2

(12) United States Patent
Taylor

(10) Patent No.: US 10,811,759 B2
(45) Date of Patent: Oct. 20, 2020

(54) MESH ANTENNA REFLECTOR WITH DEPLOYABLE PERIMETER

(71) Applicant: Eagle Technology, LLC, Melbourne, FL (US)

(72) Inventor: Robert M. Taylor, Rockledge, FL (US)

(73) Assignee: Eagle Technology, LLC, Melbourne, FL (US)

( * ) Notice: Subject to any disclaimer, the term of this patent is extended or adjusted under 35 U.S.C. 154(b) by 182 days.

(21) Appl. No.: 16/190,064

(22) Filed: Nov. 13, 2018

(65) Prior Publication Data

US 2020/0153077 A1 May 14, 2020

(51) Int. Cl.

| | |
|---|---|
| ***H01Q 15/20*** | (2006.01) |
| ***H01Q 1/12*** | (2006.01) |
| ***H01Q 1/08*** | (2006.01) |
| ***H01Q 1/28*** | (2006.01) |
| ***H01Q 15/14*** | (2006.01) |

(52) U.S. Cl.

CPC ..... *H01Q 1/1235* (2013.01); *H01Q 1/08* (2013.01); *H01Q 1/288* (2013.01); *H01Q 15/148* (2013.01)

(58) Field of Classification Search

CPC ..... H01Q 1/1235; H01Q 1/08; H01Q 1/288; H01Q 15/148; H01Q 15/168; H01Q 15/162; H01Q 15/20; H01Q 15/161

See application file for complete search history.

(56) References Cited

U.S. PATENT DOCUMENTS

| | | | |
|---|---|---|---|
| 2,806,134 | A | 9/1957 | Tarcici |
| 3,064,534 | A | 11/1962 | Tumavicus |
| 3,165,751 | A | 1/1965 | Clark |
| 3,174,397 | A | 3/1965 | Sanborn |
| 3,179,211 | A | 4/1965 | Dunlavy |
| 3,217,328 | A | 11/1965 | Miller |
| 3,224,007 | A | 12/1965 | Mathis |

(Continued)

OTHER PUBLICATIONS

Space Flight Systems, NASA News iROC, Integrated RF and Optical Communications (iROC) News Increasing the Speed of Deep Space Communications Jul. 9, 2013 https://spaceflightsystems.grc.nasa.gov/sopo/scsmo/advanced-communications-systems/iroc.

(Continued)

*Primary Examiner* — Dameon E Levi

*Assistant Examiner* — David E Lotter

(74) *Attorney, Agent, or Firm* — Fox Rothschild LLP; Robert J. Sacco; Carol E. Thorstad-Forsyth

(57) ABSTRACT

Antenna reflector has a reflector surface which forms a predetermined dish-like shape. The reflector surface includes an inner section which radially extends a first predetermined distance from a main dish axis. This inner section is immovably supported on a fixed backing structure. The reflector surface also includes an outer section comprising a deployable perimeter. A deployable support structure is comprised of a plurality of rib tips hingedly secured to the fixed backing structure, each having an elongated shape, and extending in a direction away from the main dish axis. The rib tips are configured to rotate on hinge members relative to the fixed backing structure from a first position in which the reflector antenna is made more compact for stowage, to a second position in which a diameter of the reflector surface is increased at a time of deployment.

20 Claims, 10 Drawing Sheets

(56) References Cited

U.S. PATENT DOCUMENTS 3,360,798 A 12/1967 Webb
3,385,397 A 5/1968 Robinsky
3,397,399 A 8/1968 Carman et al.
3,406,404 A 10/1968 Maier
3,473,758 A 10/1969 Webb
3,477,662 A 11/1969 Anderson
3,496,687 A 2/1970 Greenberg et al.
3,509,576 A 4/1970 McLain
3,510,086 A 5/1970 Arbeitlang et al.
3,521,290 A 7/1970 Bahiman et al.
3,530,469 A 9/1970 Dailey et al.
3,541,569 A 11/1970 Berks
3,558,219 A 1/1971 Buckingham et al.
3,576,566 A 4/1971 Cover, Jr. et al.
3,617,113 A 11/1971 Royer
3,618,111 A 11/1971 Vaughan
3,715,760 A 2/1973 Palmer
3,735,942 A 5/1973 Palz
3,735,943 A 5/1973 Fayet
3,817,481 A 6/1974 Berks et al.
3,863,870 A 2/1975 Andrews et al.
3,913,105 A 10/1975 Williamson et al.
3,978,490 A 8/1976 Fletcher et al.
4,030,102 A 6/1977 Kaplan et al.
4,030,103 A 6/1977 Campbell
4,115,784 A 9/1978 Schwerdffeger et al.
4,133,501 A 1/1979 Pentlicki
4,315,265 A 2/1982 Palmer et al.
4,337,560 A 7/1982 Slysh
4,352,113 A 9/1982 Labruyere
4,380,013 A 4/1983 Slysh
4,475,323 A 10/1984 Schwartzberg et al.
4,482,900 A 11/1984 Bilek et al.
4,498,087 A 2/1985 Imbiel et al.
4,511,901 A 4/1985 Westphal
4,527,166 A 7/1985 Luly
4,578,920 A 4/1986 Bush
4,613,870 A 9/1986 Stonier
4,636,579 A 1/1987 Hanak et al.
4,642,652 A 2/1987 Herbig et al.
4,646,102 A 2/1987 Akaeda et al.
4,658,265 A 4/1987 Heinze et al.
4,713,492 A 12/1987 Hanak
4,727,932 A 3/1988 Mahefkey
4,747,567 A 5/1988 Johnson et al.
4,769,647 A 9/1988 Herbig et al.
4,780,726 A 10/1988 Archer et al.
4,787,580 A 11/1988 Ganssle
4,811,034 A 3/1989 Kaminskas
4,825,225 A 4/1989 Waters et al.
4,862,190 A 8/1989 Palmer et al.
4,899,167 A 2/1990 Westphal
4,926,181 A 5/1990 Stumm
4,989,015 A 1/1991 Chang
5,016,418 A 5/1991 Rhodes et al.
5,104,211 A 4/1992 Schumacher et al.
5,198,832 A 3/1993 Higgins et al.
5,296,044 A 3/1994 Harvey et al.
5,446,474 A 8/1995 Wade et al.
5,451,975 A 9/1995 Miller et al.
5,487,791 A 1/1996 Everman et al.
5,488,383 A 1/1996 Friedman et al.
5,515,067 A 5/1996 Rits
5,520,747 A 5/1996 Marks
5,574,472 A 11/1996 Robinson
5,644,322 A 7/1997 Hayes et al.
5,680,145 A 10/1997 Thomson et al.
5,700,337 A 12/1997 Jacobs et al.
5,720,452 A 2/1998 Mutschler, Jr.
5,785,280 A 7/1998 Baghdasarian
5,787,671 A 8/1998 Meguro et al.
5,833,176 A 11/1998 Rubin et al.
5,857,648 A 1/1999 Dailey et al.
5,864,324 A 1/1999 Acker et al.
5,927,654 A 7/1999 Foley et al.
5,963,182 A 10/1999 Bassily
5,968,641 A 10/1999 Lewis
5,990,851 A * 11/1999 Henderson ..... H01Q 1/081 343/840
6,017,002 A 1/2000 Burke et al.
6,028,569 A 2/2000 Bassily et al.
6,028,570 A 2/2000 Gilger et al.
6,104,358 A 8/2000 Parker et al.
6,137,454 A 10/2000 Peck
6,150,995 A 11/2000 Gilger
6,208,317 B1 3/2001 Taylor et al.
6,219,009 B1 * 4/2001 Shipley ..... H01Q 1/288 343/912
6,225,965 B1 * 5/2001 Gilger ..... H01Q 1/288 343/912
6,228,441 B1 5/2001 Suzuki et al.
6,243,053 B1 6/2001 Shtarkman
6,278,416 B1 8/2001 Harless
6,313,811 B1 11/2001 Harless
6,321,503 B1 11/2001 Warren
6,323,827 B1 11/2001 Gilger et al.
6,343,442 B1 2/2002 Marks
6,344,835 B1 2/2002 Allen et al.
6,353,421 B1 3/2002 Lalezari et al.
6,373,449 B1 4/2002 Bokulic et al.
6,384,800 B1 5/2002 Bassily et al.
6,417,818 B2 7/2002 Shipley et al.
6,437,232 B1 8/2002 Dailey et al.
6,441,801 B1 8/2002 Knight et al.
6,478,261 B2 11/2002 Laraway et al.
6,542,132 B2 4/2003 Stern
6,547,190 B1 4/2003 Thompson et al.
6,568,638 B1 5/2003 Capots
6,581,883 B2 6/2003 McGee et al.
6,609,683 B2 8/2003 Bauer et al.
6,618,025 B2 9/2003 Harless
6,624,796 B1 9/2003 Talley et al.
6,637,702 B1 10/2003 McCandless
6,702,976 B2 3/2004 Sokolowski
6,735,920 B1 5/2004 Cadogan
6,772,479 B2 8/2004 Hinkley et al.
6,775,046 B2 8/2004 Hill et al.
6,828,949 B2 12/2004 Harless
6,872,433 B2 3/2005 Seward et al.
6,930,654 B2 8/2005 Schmid et al.
6,956,696 B2 10/2005 Hachkowski et al.
6,983,914 B2 1/2006 Stribling et al.
7,009,578 B2 3/2006 Nolan et al.
7,059,094 B2 6/2006 Yamawaki
7,098,867 B1 8/2006 Gullapalli
7,216,995 B2 5/2007 Harada et al.
7,429,074 B2 9/2008 McKnight et al.
7,595,769 B2 9/2009 Bassily
7,686,255 B2 3/2010 Harris
7,710,348 B2 5/2010 Taylor et al.
7,806,370 B2 10/2010 Beidleman et al.
7,897,225 B2 3/2011 Campbell et al.
8,061,660 B2 11/2011 Beidleman et al.
8,066,227 B2 11/2011 Keller et al.
8,109,472 B1 2/2012 Keller et al.
8,259,033 B2 9/2012 Taylor et al.
8,289,221 B1 10/2012 Finucane
8,356,774 B1 1/2013 Banik et al.
8,462,078 B2 6/2013 Murphey et al.
8,654,033 B2 2/2014 Sorrell et al.
8,789,796 B2 7/2014 Boccio et al.
8,839,585 B2 9/2014 Santiago Prowald et al.
9,112,282 B2 8/2015 Nurnberger et al.
9,153,860 B2 10/2015 Tserodze et al.
9,281,569 B2 3/2016 Taylor et al.
9,331,394 B2 5/2016 Toledo
9,484,636 B2 11/2016 Mobrem
9,496,621 B2 11/2016 Meschini et al.
9,608,333 B1 * 3/2017 Toledo ..... H01Q 1/14
9,660,351 B2 5/2017 Medzmariashvili et al.
9,714,519 B2 7/2017 Slade
9,755,318 B2 9/2017 Mobrem et al.
9,774,092 B2 9/2017 Fujii et al.
9,815,574 B2 11/2017 Scolamiero et al.

(56) References Cited

U.S. PATENT DOCUMENTS

| | | | | |
|---|---|---|---|---|
| 10,418,712 | B1 * | 9/2019 | Henderson | H01Q 15/161 |
| 10,516,216 | B2 * | 12/2019 | Harless | H01Q 1/1235 |
| 10,601,142 | B2 * | 3/2020 | Henderson | H01Q 19/134 |
| 2007/0200789 | A1 * | 8/2007 | Bassily | H01Q 15/168 343/915 |
| 2015/0244081 | A1 | 8/2015 | Mobrem | |
| 2016/0352022 | A1 * | 12/2016 | Thomson | H01Q 1/288 |

OTHER PUBLICATIONS

Cornwell, D.M., "NASA's Optical Communications Program for 2015 and Beyond," Proc. of SPIE, vol. 9354, 93540E-1, Free-Space Laser Communication and Atmospheric Propagation XXVII (Mar. 16, 2015); doi: 10.1117/12.2087132.

* cited by examiner

MESH ANTENNA REFLECTOR WITH DEPLOYABLE PERIMETER

BACKGROUND

Statement of the Technical Field

The technical field of this disclosure is reflector antennas, and more particularly reflector antennas which are suitable for space-based applications.

Description of the Related Art

The related art concerns reflector antennas suitable for space-based applications. In an antenna system, antenna gain is proportional to aperture area and higher antenna gain allows higher communications rates. Accordingly, large antenna apertures comprise a desirable feature with regard to spacecraft antennas. However, launch vehicle fairings have limited volume and cross section. This constraint necessarily limits the physical dimensions of any antenna which can be deployed in a space vehicle without the use of some type of mechanical deployment system. Mechanical deployment systems for reflector antennas offer many advantages but they are inherently expensive and increase the risk of failure.

Traditional deployable mesh reflectors offer a high ratio of expansion from the stowed to the deployed state. However, they are quite complex and therefore pose certain risks to mission success. Two basic technologies have been used to achieve deployable reflector antennas in scenarios where relatively low expansion ratios are acceptable. These two basic technologies include segmented reflectors and spring-back reflectors. Segmented reflectors divide the reflective surface into two or more sections that are then folded or stacked to reduce their overall size and fit in a fairing of a launch vehicle. The James Webb Space Telescope (JWST) main mirror and the 1st generation satellites for certain commercial satellite radio services are examples of segmented reflectors.

Spring-back reflectors use a reflective surface that is flexible and can be bent into a curved shape to reduce the overall size. The reflectors on the Mobile Satellite (MSAT) mobile telephony service and on the 2nd and 3rd generation Tracking and Data Relay Satellite (TDRS) are examples of spring-back reflectors.

SUMMARY

This document concerns an antenna reflector with a deployable perimeter. The antenna reflector is comprised of a reflector surface which forms a predetermined dish-like shape and has a main dish axis. The reflector surface is comprised of an inner section which radially extends a first predetermined distance L1 from the main dish axis. This inner section is immovably supported on a fixed backing structure. The reflector surface also includes an outer section comprising a deployable perimeter. A deployable support structure is provided to movably support at least a portion of the outer section. This deployable support structure is comprised of a plurality of rib tips hingedly secured to the fixed backing structure, each having an elongated shape, and extending in a direction away from the main dish axis. The rib tips are configured to rotate on hinge members relative to the fixed backing structure from a first position in which the reflector antenna is made more compact for stowage, to a second position in which a diameter of the reflector surface is increased at a time of deployment. According to one aspect, the outer section extends a second predetermined distance L2 from an outer periphery of the inner section when the rib tips are in the second position. In some scenarios, a magnitude of L2 is a value between 0.5*L1 and 4*L1.

The inner section is comprised of a pliant RF reflector material which is conformed to the dish-like shape by the fixed backing structure. For example, the pliant RF reflector material can be a conductive metal mesh. Similarly, the outer section can be comprised of the pliant RF reflector material, and conformed to the dish-like shape by the deployable support structure. In some scenarios, the inner section and the outer section are formed of a single continuous sheet of the pliant RF reflector material.

In some scenarios, the plurality of rib tips are comprised of adjacent rib tip pairs. These rib tip pairs are configured to rotate respectively on first and second hinges and extend to distal rib tip ends. According to one aspect, the first and second hinges can be configured to cause a distance between the distal rib tip ends to increase as the rib tips are rotated on the first and second hinges from the first position to the second position. In such a scenario, a distance between the distal rib tip ends of a first rib tip of a first adjacent rib tip pair and a third rib tip of a second adjacent rib tip pair is decreased as the rib tips move from the first position to the second position.

BRIEF DESCRIPTION OF THE DRAWINGS

This disclosure is facilitated by reference to the following drawing figures, in which like numerals represent like items throughout the figures, and in which.

DETAILED DESCRIPTION

Figure 1A:
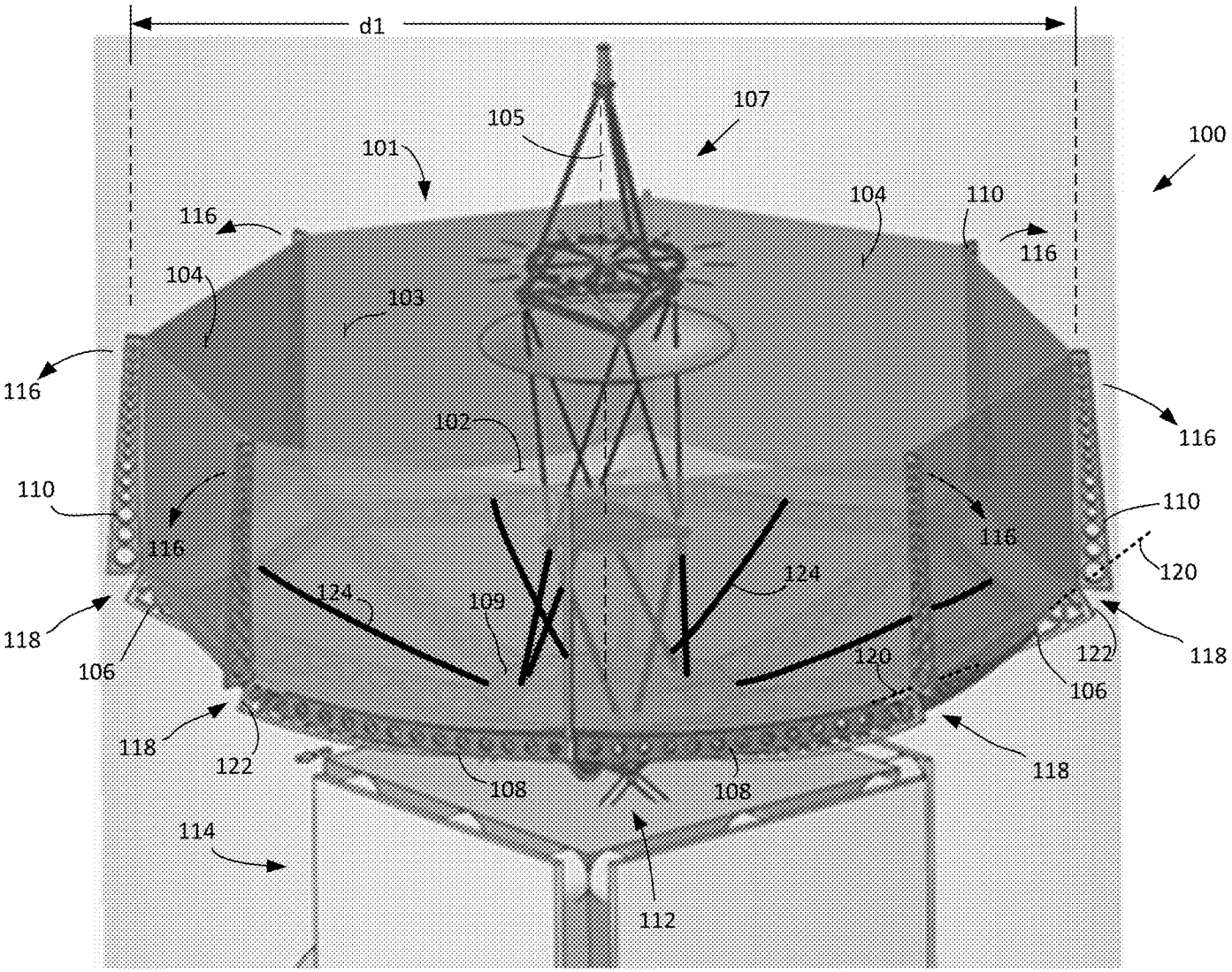
FIGS. 1A and 1B are a set of drawings which are useful for understanding a reflector antenna with a deployable perimeter portion that extends fully around a periphery of the reflector surface.

It will be readily understood that the solution described herein and illustrated in the appended figures could involve a wide variety of different configurations. Thus, the following more detailed description, as represented in the figures, is not intended to limit the scope of the present disclosure, but is merely representative of certain implementations in various different scenarios. While the various aspects are presented in the drawings, the drawings are not necessarily drawn to scale unless specifically indicated.

Traditional mesh reflectors are only used where high gain and compact stowage is essential to the mission. This limited usage is due to the high complexity and cost of these deployable antenna systems. Spring-back reflectors and segmented reflectors are potential alternatives to conventional deployable mesh reflectors, but are still more expensive than simple fixed aperture reflectors. For the foregoing reasons, many satellite communication applications choose to use simple fixed aperture reflectors. A solution presented herein involves a low-cost alternative to such fixed aperture antennas while still facilitating a modest increase in aperture size.

The solution concerns a mesh antenna reflector with a deployable perimeter. This arrangement allows a single mesh surface to be created, with only a portion of the mesh surface being stowed during transport. By reducing the area that is deployed, the cost and complexity of the deployment mechanism is greatly reduced. A further advantage of this arrangement is that it facilitates a more graceful degradation in reflector antenna performance in the event of deployment malfunctions. The resulting system can offer a lower cost, less complex reflector as compared to fixed aperture reflectors, while still achieving a modest ratio of expansion. This design represents an avenue for a deployable reflector to be used in many applications where fixed apertures are currently used. Consequently, this solution could be used on many communication satellites to offer a modest aperture increase with a modest increase in cost. These and other advantages of a solution for a reflector antenna system will become more apparent from the following more detailed description.

Figure 1B:
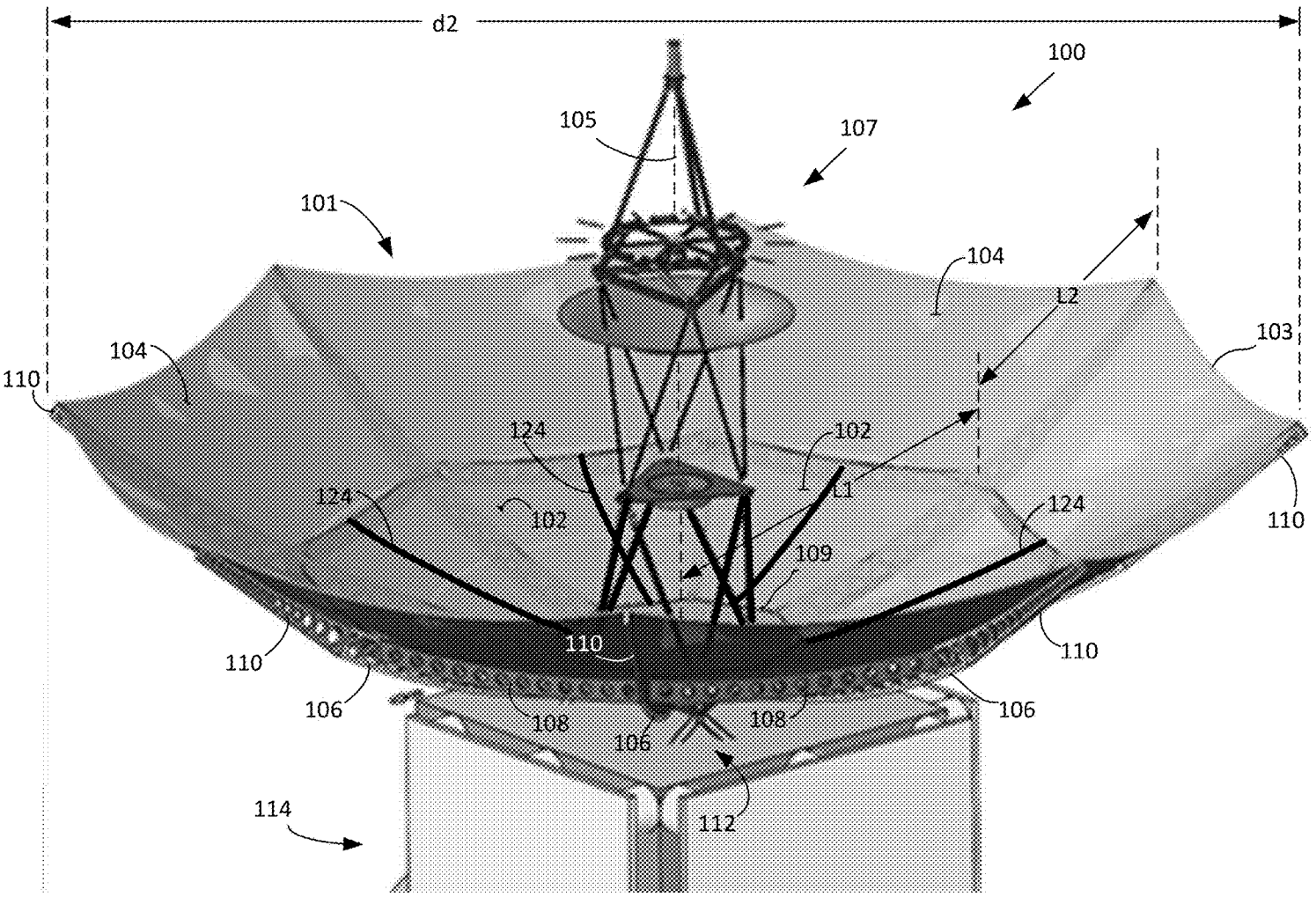

It can be observed in FIGS. 1A and 1B, that a reflector antenna system 100 can include a reflector 101. A reflector antenna system 100 can in some scenarios be mounted on a space vehicle 114 by means of a structural hub 109 and a base structure 112. Depending on the configuration of the reflector antenna system 100, a tower 107 can be provided. For example, the tower can be aligned with a central axis 105 of the reflector as shown. The tower can be secured to the structural hub 109 and/or to the base structure 112.

The reflector 101 includes a reflector surface 103 comprised of a conductive material that is suitable for reflecting radio frequency (RF) signals. In some scenarios, the material forming the reflector surface can be comprised of a pliant or highly flexible material, such as a woven or knitted metal mesh. In other scenarios, the reflector material can be a carbon fiber reinforced silicone (CFRS) type material. Reflector surfaces of each type are well-known in the in the field of deployable reflector antennas and therefore will not be described in detail. However, it should be understood that in both cases these reflector materials are pliant and highly flexible so that they can be folded and later unfolded to form a larger aperture reflector antenna. For purposes of the solution presented herein, the exact type of material used to form the reflector surface is not critical. Accordingly, any other type of material now known or known in the future can be used to form the reflector surface 103, provided that the material has similar properties to those reflecting surfaces described herein.

In the reflector antenna system 100, the reflector 101 has an inner section 102 in which the reflector surface 103 is fixed to a backing structure. The backing structure supports the inner section of the reflector surface 103. The exact configuration of the backing structure is not critical provided that the structure is lightweight, rigid, and at least partially defines a reflector shape that is required for a particular reflector surface 103. In a scenario illustrated in FIGS. 1A and 1B, the backing surface is formed from a structural hub 109, a plurality of radial ribs 106 and a plurality of secondary supports 108 which extend between each of the ribs. The plurality of ribs 106 extend from the structural hub in a predetermined distance in radial directions relative to the central axis 105 of the reflector 101. The plurality of radial ribs 106 and the plurality of secondary supports 108 can together define the outline of a regular polygon. In some scenarios, the geometric center of such regular polygon can be aligned coaxial with the central axis as shown. In other configurations, the structure could be supported from one edge and have ribs that spread out across the surface from the attachment point; or the ribs could be two parallel sets that divide the surface up into rectangular sections or three parallel sets that divide the surface up into roughly equilateral triangles.

The material comprising the reflector surface 103 can be secured directly or indirectly to the backing structure by any suitable means. For example, fasteners, links or other types mechanical fittings (not shown) can be used to facilitate the attachment directly to the elements of the backing structure. In some scenarios, adhesives can be used to facilitate such attachment. In still other scenarios, the material comprising the reflector surface can be attached indirectly to the backing structure using suitable rigid standoffs which extend a predetermined distance between the backing structure and the reflector surface. In such scenarios, the fasteners, links or other types of mechanical fittings can be similarly used to attach the reflector surface to the standoffs.

Figure 6A:
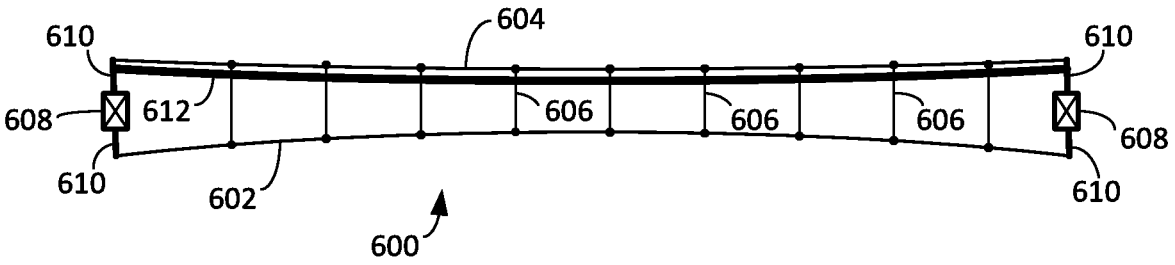
FIGS. 6A and 6B are a set of drawings which are useful for understanding how a plurality of cords can be used to help shape a reflector surface.
Figure 6B:
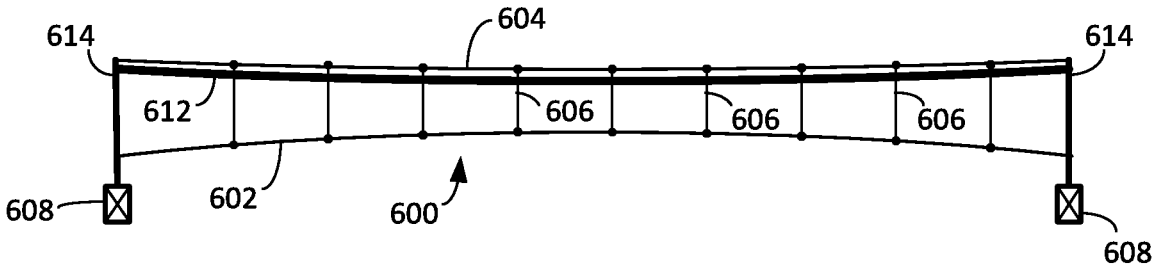

According to one aspect, additional lightweight rigid surface support elements 124 could be added to the backing structure to facilitate attachment of the reflector surface 103. These additional surface support elements are structural members which can be used to increase the number of attachment points for the reflector surface 103. Advantageously, such additional surface support elements are manufactured from a material that is very light in weight. A function of the surface support elements 124 is to help improve the shape of the reflector surface 103. Shaping of the reflector surface 103 can in some scenarios also be facilitated by a network of cords that are tensioned to position the mesh reflector surface in the correct shape. Cord networks used for reflector surface shaping purposes are known in the art and therefore will not be described in detail. However, it can be observed in FIGS. 6A and 6B that a cord network can include a rear catenary cord 602, a front catenary cord 604, and a plurality of ties 606 which connect at intervals between the front and rear catenary cords. The cord network can be supported by standoffs 610, 614 from the backing structure 608. In some scenarios, flexible tensioned standoffs 614 can extend from the backing structure 608 in a direction toward the reflector surface 612 (as shown in FIG. 6B). Alternatively, rigid compression standoffs 610 can be used which extend both toward and away from the reflector surface as shown in FIG. 6A.

In the example shown, the inner section 102 is formed from a set of eight (8) radial ribs 106 and eight (8) secondary supports 108 such that the regular polygon is an octagon. But it should be appreciated that the solution is not limited to this particular shape. In other scenarios, the inner section 102 could be instead configured to define a regular polygon with a different number of sides (e.g., six, eight, ten or twelve sides). In such scenarios, a different number of radial ribs and secondary supports could be provided to form the backing structure. Further, in some scenarios, the inner section 102 could define an irregular polygon. All such alternative configurations are contemplated within the scope of the solution disclosed herein.

The structural hub 109 can be comprised of a rigid ring-like member. In some scenarios, the structural hub 109 can have a shape or peripheral outline which generally corresponds to the shape of the inner section 102. In some scenarios, the radial ribs 106, the secondary supports 108, and the structural hub 109 which form the backing structure can each be comprised of lightweight honeycomb panels similar to those shown in FIGS. 1A and 1B. However, other configurations are possible. For example, in some scenarios the backing structure could be comprised of tubular composites which are formed to match the desired curvature.

The reflector surface comprising the inner section 102 is fixed to the backing structure formed of the radial ribs 106 and secondary supports 108. In some scenarios, this arrangement of fixed radial ribs and secondary supports can be used instead of a tension cord network as may be often found in a conventional unfurlable antenna. As such, it should be understood that the fixed support structure of the inner section 102 does not have the ability to be collapsed in size for transport or mechanically unfurled for deployment on orbit. In this regard, the inner section 102 can be understood as having a design that is similar to a configuration of a fixed mesh reflector (FMR). As is known, an FMR uses a mesh reflector material surface that is similar to that which is used in an unfurlable reflector antenna. However, with an FMR the mesh reflector surface is attached to a stable fixed framework which is configured to support the mesh. In other scenarios, a tensioned cord network as described with respect to FIGS. 6A-6B can be used help shape and support the reflector surface comprising the inner section 102. Accordingly, it will be understood that the inner section 102 could use rigid fixed supports as shown in FIGS. 1A and 1B, but could also use a tensioned cord network to shape the reflector surface. In still other scenarios, both mechanism can be used. In other words, a combination of rigid fixed supports as shown in FIGS. 1A-1B and tensioned cords as explained in reference to FIGS. 6A-6B.

The reflector 101 also includes an outer section 104 disposed around a periphery of the inner section 102. In some scenarios, the inner section 102 and the outer section 104 can have a coaxial configuration as shown with respect to the central axis 105. In such a scenario, the outer section 104 will have a toroidal or ring-like configuration that surrounds the inner section 102.

Outside the periphery of the inner section 102 the material comprising the outer section 104 of the reflector surface is not directly supported by the fixed backing structure (ribs 106 and secondary supports 108). Instead, the outer section 104 is advantageously supported by a plurality of folding rib tips 110. The rib tips 110 can be secured to the backing structure at the outer periphery of the inner section 102. For example, in the scenario shown in FIGS. 1A and 1B, the rib tips 110 are disposed on end portions of the ribs 106 that are located distal from the central axis 105. The folding rib tips 110 are secured to the backing structure by hinges 118, which in some scenarios can be spring-mass damper hinges. The rib tips 110 could be comprised of a honeycomb panel similar to that which is used for ribs 106 or they could be formed of graphite tubes. In some scenarios, each of the rib tips can support a network of tensile cords similar to those shown in FIGS. 6A and 6B to help forms the RF reflective mesh of the outer section 105 into a desired shape (e.g., a parabolic shape).

Figure 7A:
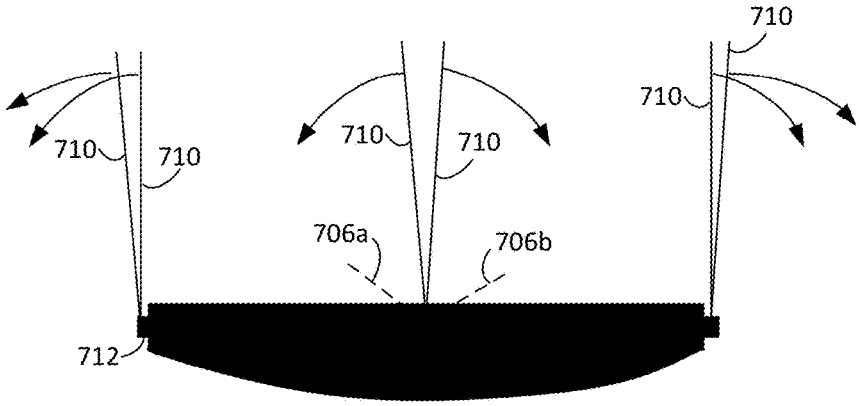
FIGS. 7A and 7B are a set of drawings which are useful for understanding an alternative rib tip configuration.
Figure 7B:
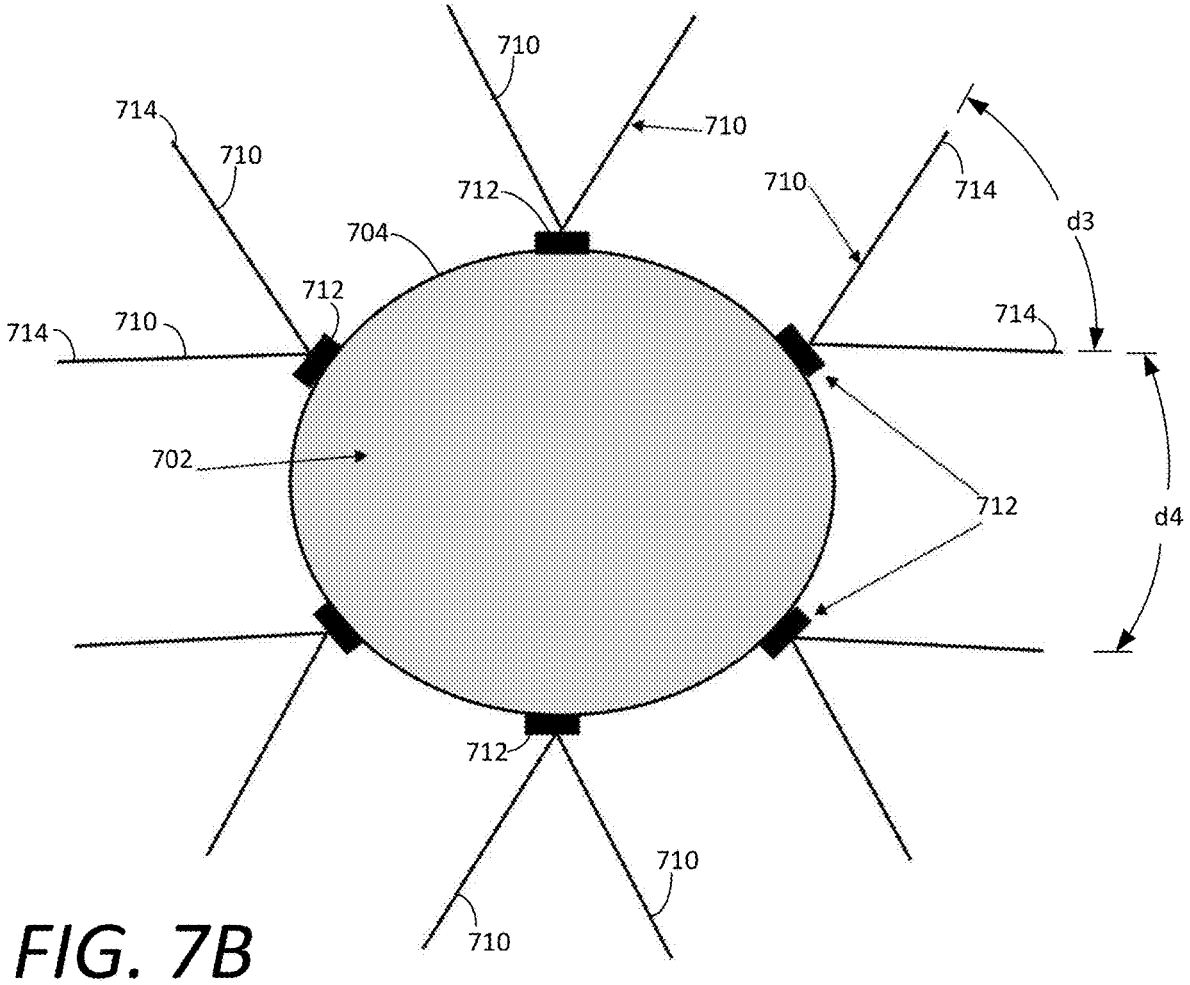

In some scenarios, the rib tips can extend radially from a central axis 105 of the antenna as shown in FIGS. 1A and 1B. However, the solution is limited in this respect and it should be appreciated that other configurations of the rib tips are also possible. For example, FIGS. 7A and 7B are a set of schematic diagrams which shows that a plurality of rib tips 710 could be attached to an inner section 702 (in pairs, for example) at a hinge member 712. Hinge member 712 is configured to cause each rib tip 710 to rotate about a different rotation axis 706*a*, 706*b* which are not aligned. In some scenario, this can be implemented in a single compound hinge structure with two separate axis of rotation. However in other scenarios, the hinge member 712 can comprise separate hinge elements to facilitate rotation of each rib. A plurality of the hinge members 712 with associated pairs of rib tips 710 can be disposed at intervals around the outer periphery 704 of the inner section 702.

With the foregoing configuration, the rib tips can rotate on hinge members 712 from a stowed position shown in FIG. 7A to a deployed position shown in FIG. 7B. With such a configuration, distal ends 714 of each pair of rib tips 710 can be configured to spread apart as they rotate about hinge rotation axes 706*a*, 706*b*, thereby increasing distance d3 as they transition from the stowed configuration in FIG. 7A to the deployed configuration in FIG. 7B. This arrangement will result in decreasing a distance d4 between distal ends 714 of rib tips 710 mounted to adjacent hinge members 712 as the rib tips move to their deployed configuration.

The ribs 106 will generally extend a distance L1 from a central axis 105 and the rib tips will have an elongated length L2 which extends from the outer periphery of the inner section 102 to an outer peripheral edge of the reflector surface 103. FIGS. 1A and 1B illustrate a scenario in which L1 and L2 are approximately the same. However, the solution is not limited in this respect and in some scenarios each of the rib tips 110 can have a length L2 that is less than the length L1 (e.g. L2=L1 to 0.5*L1). In other scenarios, the rib tips 110 can have a length L2 that is equal to or greater than the length of the ribs 106 (e.g., L2=L1 to 4*L1). A configuration in which L2>L1 can be advantage in some scenarios because the rib tips 110 can be folded inward toward the central axis of the reflector, and secured there to help support them for launch. In such a scenario a value of L2=1.7*L1 to 2*L1 can be advantageous. Accordingly, a magnitude of L2 can in some scenarios be a value between L1 and 3*L1. In general, a value of L2 between 0.5*L1 to 4*L1 is suitable for many configurations. In contrast, it should be understood that a conventional radial rib reflector will have folding ribs which are many times longer than the diameter of a center hub (e.g., 5 times larger than the diameter of a central hub which would be L2=10*L1).

During a period of time associated with launch of the reflector antenna into space aboard a launch vehicle, the rib tips 110 can be advantageously rotated upward to a first position as shown in FIG. 1A so as to limit the overall diameter of the reflector 101 to a distance d1. The hinges 118 allow each rib tip 110 to deploy by rotating about a hinge axis 120 from the position shown in FIG. 1A to the position shown in FIG. 1B. For example, in some scenarios the rib tips 110 can be configured to rotate through an angle of between 50° to 70° when transitioning between the first position and the second position. In other scenarios, the rib tips can be configured to rotate through an angle of between about 40° to 80°. In the example shown in FIGS. 1A and 1B, the rib tips rotate through an angle of about 60°.

Figure 8A:
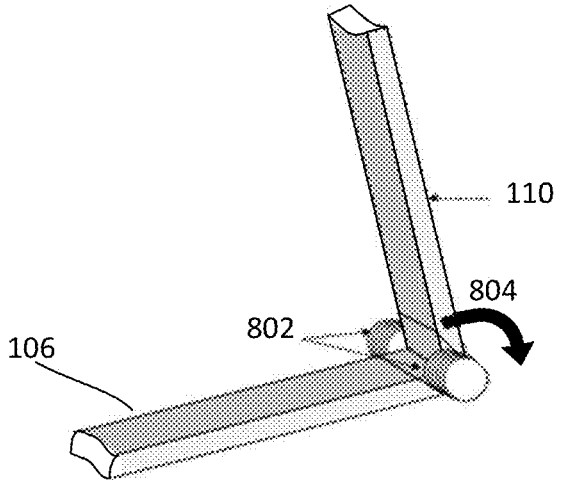
FIGS. 8A and 8B are a set of drawings that are useful for understanding a spring bias arrangement to facilitate deployment of a rib tip.
Figure 8B:
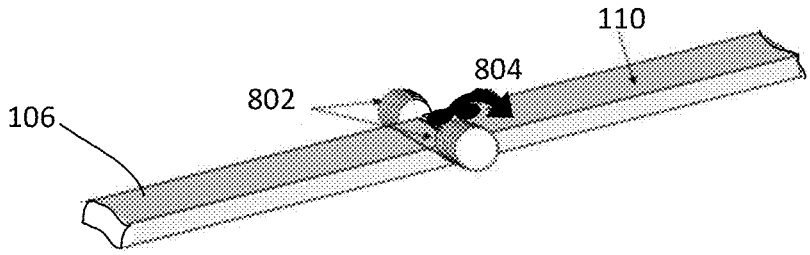

In some scenarios, the rotation of the rib tips 110 can be facilitated by spring members. Such a scenario is illustrated in FIGS. 8A and 8B where springs 802 are configured to cause the rib tips 110 to rotate in the direction of arrow 804 from the first stowed position shown in FIG. 8A, to a second deployed position in which the the rib tips 110 are deployed after being released or unlocked In other scenarios, the rotation of the rib tips 110 can be facilitated by one or more cables which extend from the rib tips 110 to a spool associated with a central winch. When in their fully deployed second position shown in FIG. 1B, the relatively short rib tips are lightly loaded to stretch the reflector surface 103.

In the example shown in FIG. 1A it can be observed that the reflector 101 is in a cup-up configuration whereby the rib tips 110 are approximately aligned with the central axis 105 during launch. But the solution is not limited in this regard and in other scenarios it can be advantageous to instead rotate the rib tips 110 so that the tip ends 110 point inwardly toward the central axis 105. In such a scenario, the rib tips 110 could be folded completely inward and secured to the ribs 106. Such an arrangement could be advantageous to allow the reflector to be packaged on opposing sides of a traditional geostationary communications satellite. For example, in some scenarios these opposing sides may be configured to face in an East and West direction of such geostationary communications satellite when the satellite is in position on orbit. In other scenarios, if the rib tips are longer than the radius of the fixed section (L2≥L1), then the rib tips can be inclined inward and attached to each other at a location aligned with the central axis of the reflector so as to form a triangular or conical structure for a duration of satellite launch and transit to its on-orbit location.

When the rib tips 110 rotate to the position shown in FIG. 1B, they engage a hard stop 122 which prevents the hinges from further rotation. This hard stop could engage the hinge or rib directly or the cord network supporting the reflective surface could stop the travel of the rib tips. Accordingly, after the reflector antenna 100 has been launched into orbit, the reflector 101 with rib tips deployed can have a diameter equal to d2, where d2 is greater than d1. Choosing d1 to be less than d2 can be advantageous in some scenarios for allowing the reflector antenna to fit within a fairing of a launch vehicle. The movable outer rib tips allow the aperture of the antenna to be increased once the reflector 101 arrives on orbit. The combination of fixed inner section, and folding outer radial tips provides a cost effective way of facilitating modest increases in reflector diameter, without the cost of a conventional deployable antenna arrangement.

One advantage of the solution disclosed herein is that there is no synchronization required in the deployment of the rib tips 110. Because the rib tips 110 are much shorter than those used in a conventional radial rib reflector antenna, both the moment required and the accuracy required for deployment are significantly reduced.

Although the inner and outer sections 102, 104 are referenced as separate sections for the purposes of this description, the reflector surface 103 is advantageously comprised of a continuous surface which extends over the entire reflector 101. For example, a continuous layer of conductive mesh could extend over the entire reflector surface 103. Of course, the solution is not limited in this respect and in some scenarios, the material comprising the reflector surface 103 could be separated along an outer edge of the inner section 102 that is fixed, and an inner edge of the outer section 104 that is deployable. However, one drawback of such an arrangement is that it could potentially cause undesirable scalloping of the reflector surface in the region along the outer peripheral edge of the inner section 102 and the inner peripheral edge of the outer section 104. Assuming this issue is addressed, the outer section 104 could potentially be discontinuous with the inner section 102 the reflector surface 103 and in such scenarios the inner section 102 could be formed of the same or a different type of material as compared to the outer section 104. For example, in such a scenario the outer section 104 could be a pliant material (such as a metal mesh) whereas the inner section 102 could be comprised of a reflector surface that is rigid or semi-rigid.

Figure 9A:
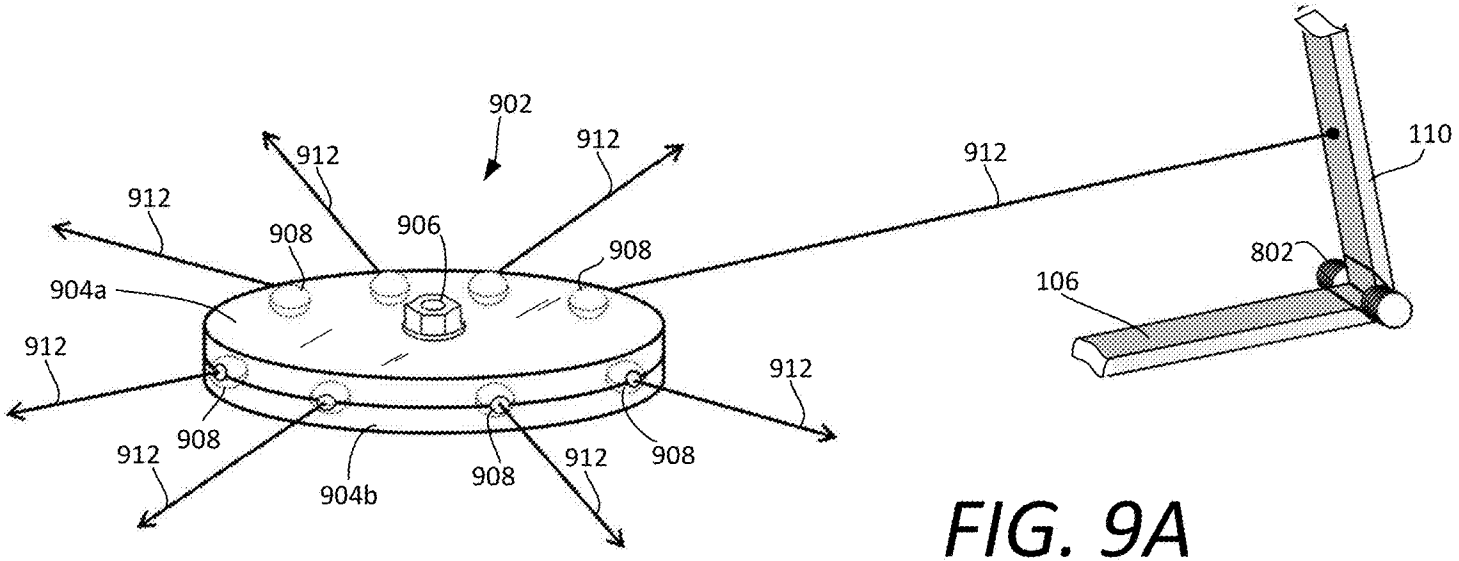
FIGS. 9A and 9B are a set of drawings which are useful for understanding a rib tip retention and release mechanism.
Figure 9B:
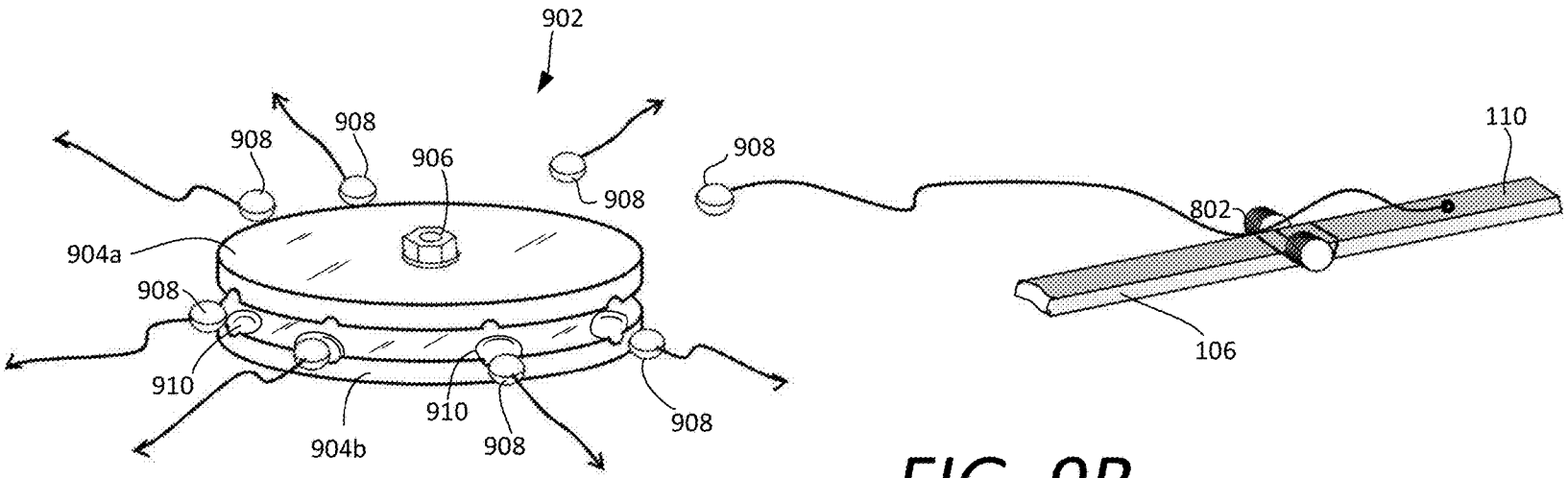

As noted above, the rib tips 110 can be positioned in a stowed configuration during launch of the antenna system into orbit. The rib tips 110 can be held in the stowed position using any known methodology now know, or known in the future. For example, in some scenarios the restraining system can a conventional restraining system as is commonly used in a conventional radial rib reflector which provides multiple release points from a radial ring with a single pin-puller. These types of restraint systems are well-known in the art and therefore will not be described in detail. However, FIGS. 9A and 9B show one such example in which a plurality of spheres 908 are secured in recesses 910 disposed in opposing faces of a pair of plates 904*a*, 904*b*. During launch, the opposing faces are urged toward each other, whereby the spheres 908 are captured within the recesses 910. A threaded release bolt 906 can be used to fix the pair of plates together as shown in FIG. 9A during periods when the reflector is stowed for launch.

Each of the spheres is connected to a first end of a cord 912. An opposing second end of each such cord 912 is coupled to a rib tip 110 as shown. Consequently, the cords 912 constrain the rib tips 110 from rotating to the deployed position shown in FIG. 9B. When the release bolt is loosened or unthreaded (e.g., by a motor) to allow the plates 904*a*, 904*b* to separate as shown in FIG. 9B, the spheres 908 are released from the recesses 910 and the cords 912 are allowed to become slack. The slackness in the cords 912 allows the rib tips 110 to rotate (e.g., as a result of spring bias) to the deployed condition shown in FIG. 9B.

Figure 2:
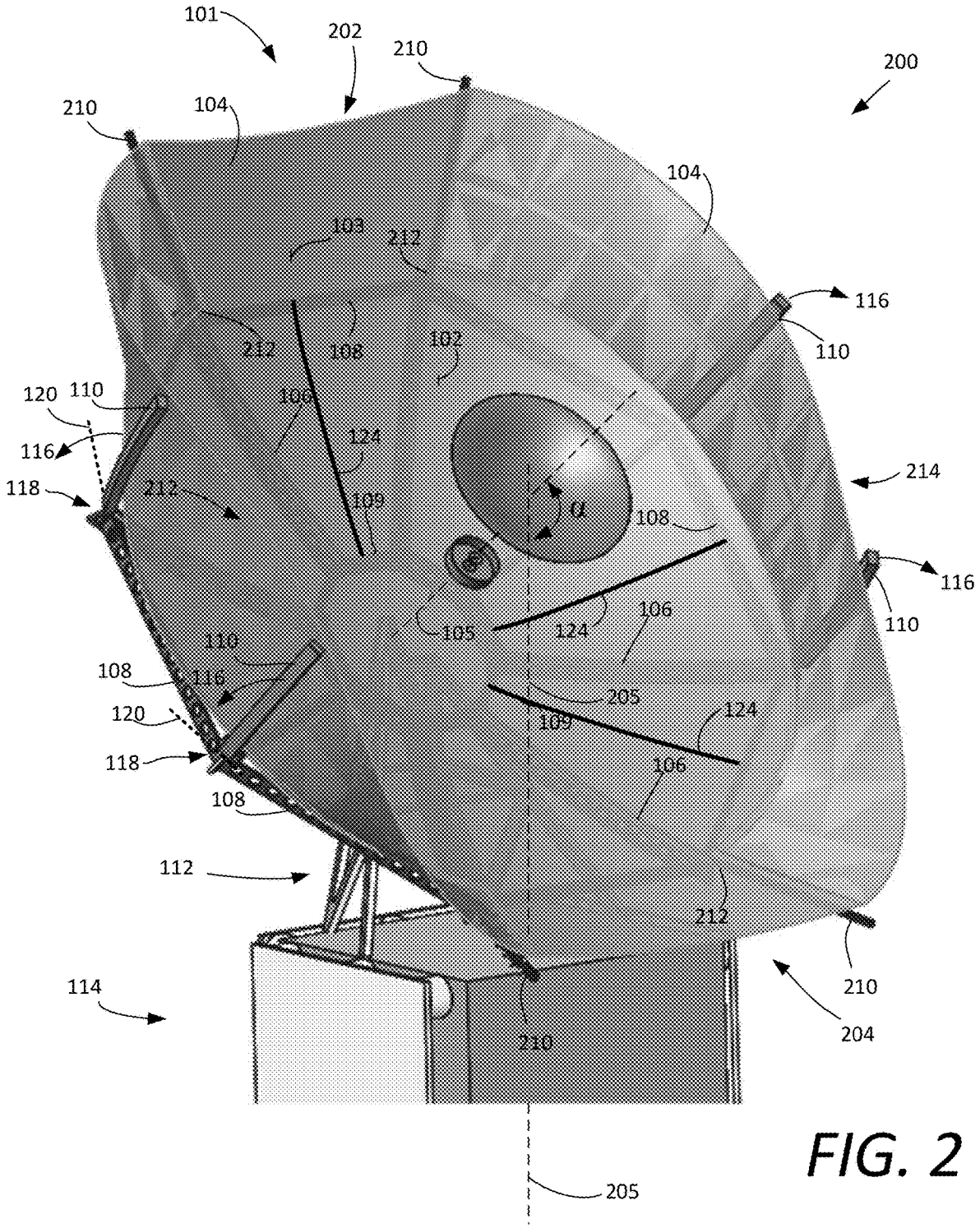
FIG. 2 is a drawing which is useful for understanding a reflector antenna with a deployable perimeter portion that extends only partially around a periphery of the reflector surface.

In some scenarios, only a portion of the outer section 104 can be secured to the rotatable rib tips 110 while other portions of the outer section 104 are secured to a fixed rib extensions of the backing structure. Such a scenario is illustrated in FIG. 2 which shows a reflector antenna system 200. For reasons which are explained below in greater detail, the configuration shown in FIG. 2 can be advantageous, particularly in a scenario where the central axis 105 of the reflector 101 is not aligned with a central axis 205 of a communications satellite 114 and/or launch vehicle compartment 302.

Reflector antenna system 200 is similar to reflector system 100. Accordingly, the discussion of the reflector antenna system 100 is sufficient for understanding most features of the reflector system 200. In this regard it can be observed that the reflector system 200 includes a reflector 101 comprised of an inner section, 102 and an outer section 104, a backing structure formed of a plurality of ribs 105, secondary supports 108, and a support hub 109 which is mounted on a base portion 112. Similarly, at least a stowable portion 212, 214 of the outer section 104 is supported on rib tips 110 which rotate on hinges 118 to facilitate a deployment as described with respect to FIGS. 1A and 1B.

However, in the antenna system 200 the outer section 104 of reflector 101 also includes one or more fixed portions 202, 204 of the outer section 104 which are fixed in place relative to the ribs 106 and inner section 102. Fixed portion(s) 202, 204 is/are advantageously supported on a plurality of lightweight rigid rib extensions 210. The rib extensions 210 are fixed in position relative to the ribs 106 and inner section 102. As such, the rib extensions 210 do not move or otherwise rotate (e.g., on a hinge 118) relative to the ribs 106 and/or inner section 102 of the reflector 101. The rib extensions 210 can each be comprised of a lightweight honeycomb panel or a tubular composite which is formed to match the desired curvature.

A base of each rib extension 210 can be secured to the inner section 102 at an attachment point 212. The attachment of these elements can be facilitated by any suitable means including fasteners, adhesives, and so on. The relatively short length of the rib extensions 210 are lightly loaded to stretch the reflector surface 103 so that a smooth curved surface is formed.

In the antenna system 200, the rib tips 110 can be rotated so that they are aligned during launch with the central axis 105. Alternatively, the rib tips 110 can be rotated so that the tip ends 110 point inwardly toward the central axis 105. In such a scenario, the rib tips 110 could be folded completely inward and secured to the ribs 106. With the antenna system 200, the hinge tips 110 rotate in direction 116 to deploy stowable portions 212, 214 in a manner similar to that which has been described herein with respect to reflector antenna system 100.

Figure 3:
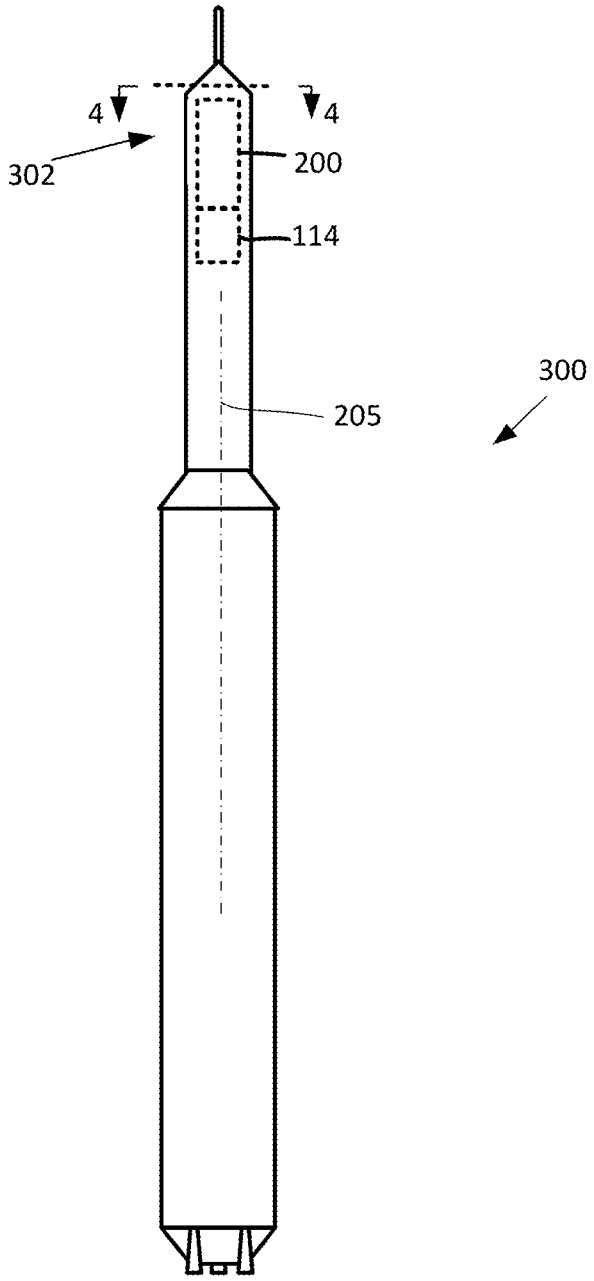
FIG. 3 is a drawing which is useful for understanding how the reflector antenna in FIG. 2 can be disposed within a compartment of a launch vehicle.
Figure 4:
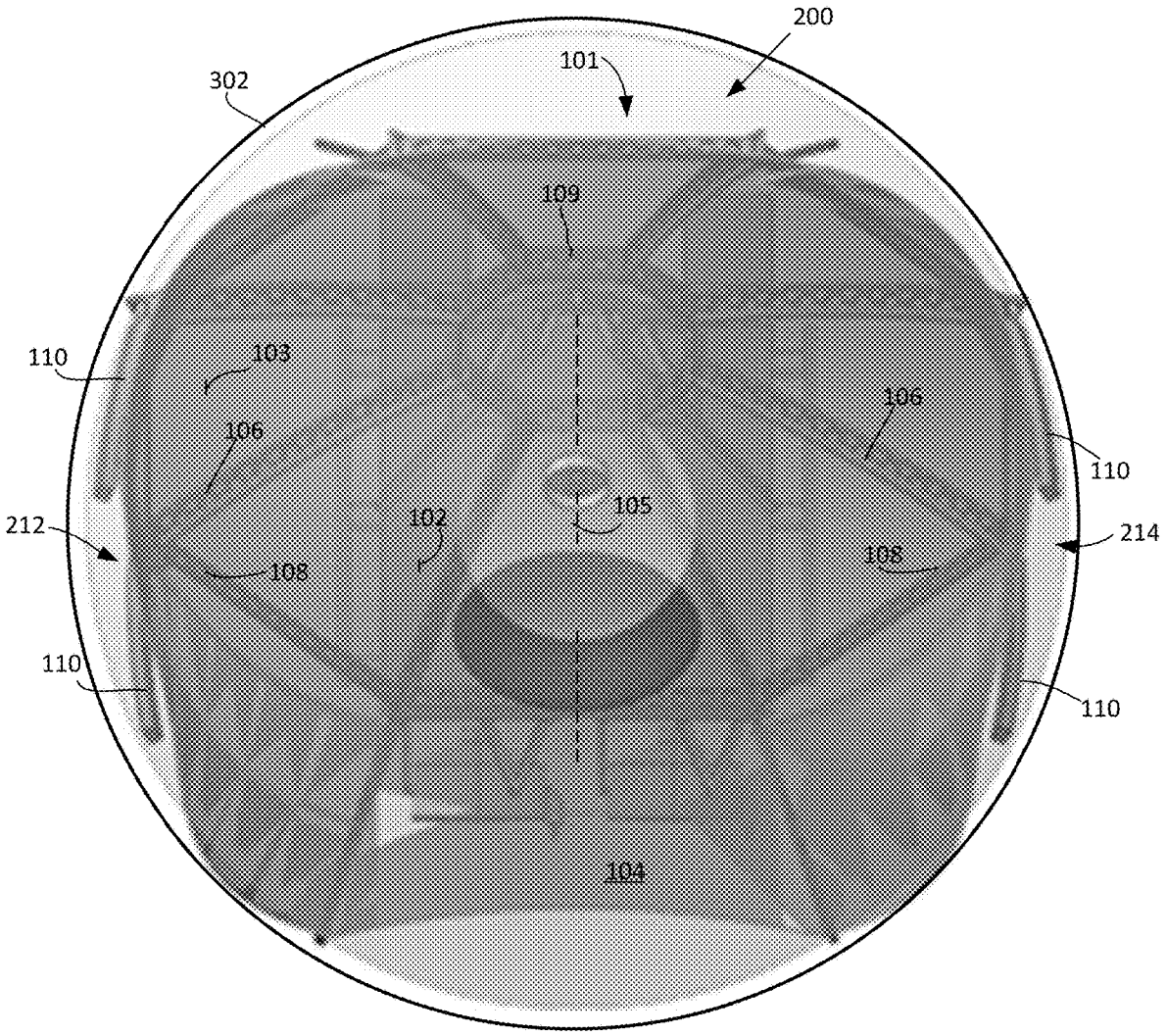
FIG. 4 is a cross-sectional view taken along line 4-4 in FIG. 3, which is useful for understanding how a deployable perimeter portion of a reflector antenna facilitates fitment of the reflector antenna within a compartment of a launch vehicle.
Figure 5:
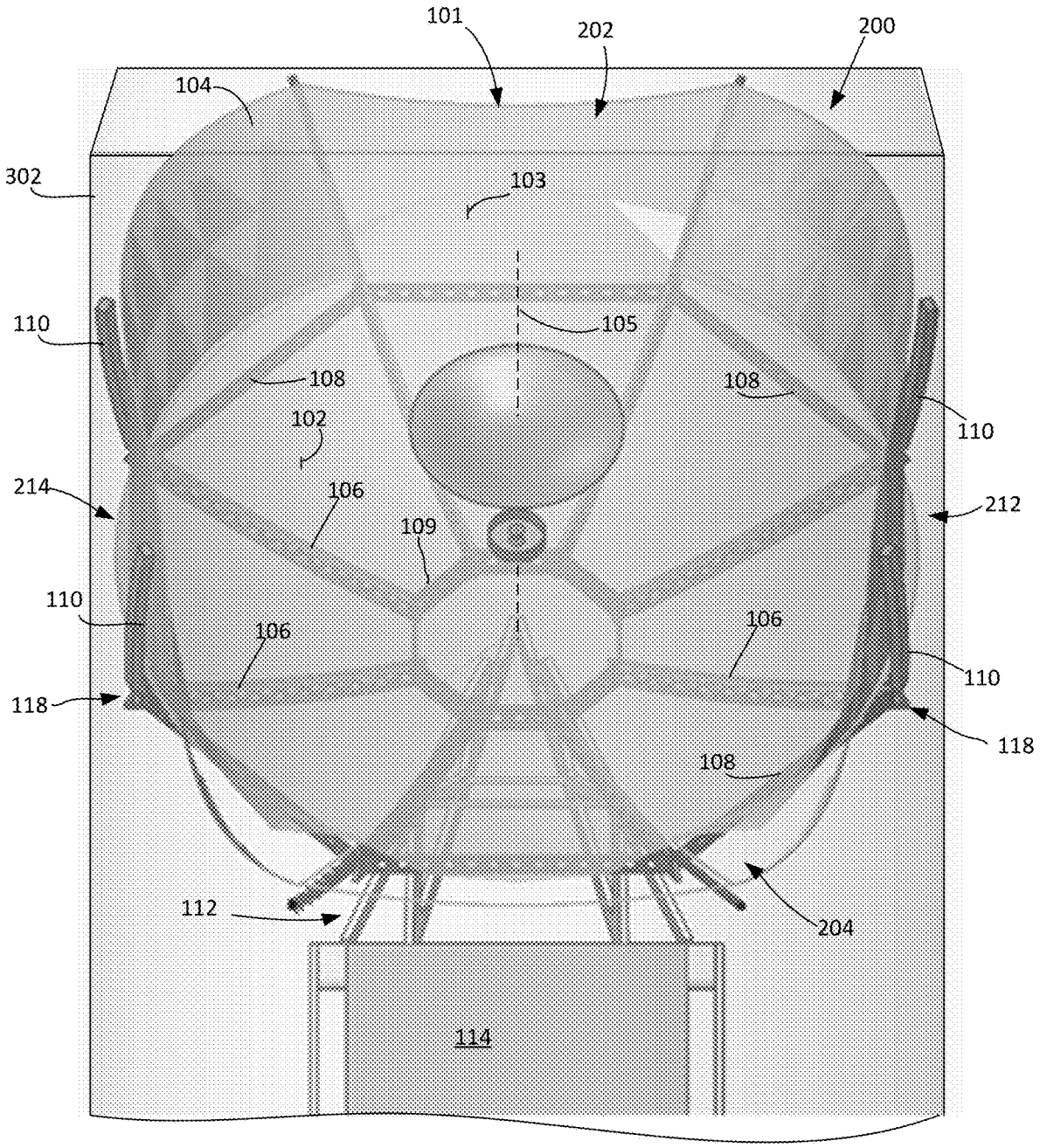
FIG. 5 is a side view of the antenna of FIG. 2, which is useful for understanding how a deployable perimeter portion of a reflector antenna facilitates fitment of the reflector antenna within a compartment of a launch vehicle.

An advantage of the arrangement shown in FIG. 2 can be best understood with reference to FIGS. 3-5. FIG. 3 shows a conceptual drawing in which the antenna system 200 and communication satellite 114 are stowed in a compartment 302 of a launch vehicle 300. FIG. 4 is a cross sectional view of the compartment 302, taken along line 4-4 and showing the antenna system 200 with satellite 114 in a launch configuration. FIG. 5 shows a side view of the same compartment 302 partially cutaway to reveal the antenna system and satellite 114 disposed therein. It may be observed in FIG. 4 that rotation of stowable portions 202, 204 to a stowed configuration shown in FIG. 2 can, by itself be sufficient to allow the antenna system 200 to fit within the launch compartment 302, provided that the antenna central axis 105 is disposed at an acute angle $\alpha$ relative to the launch compartment central axis 205. A similar observation can be made in FIG. 5. So the configuration shown in FIG. 2 can facilitate a modestly larger reflector antenna aperture as compared to a fixed configuration reflector, at relatively low cost differential, and only a modest increase in complexity. The arrangement shown in FIG. 2 can also be used to package a reflector on opposing sides of a geostationary communications satellite where the bus is often taller than it is wide. These opposing sides can be selected so that they are oriented toward an East and West directions respectively when the satellite is disposed in such geostationary orbit. In this case, the folded sides of the reflector would be rotated nearly 180° inward and constrained between the reflector and the bus.

The described features, advantages and characteristics disclosed herein may be combined in any suitable manner. One skilled in the relevant art will recognize, in light of the description herein, that the disclosed systems and/or methods can be practiced without one or more of the specific features. In other instances, additional features and advantages may be recognized in certain scenarios that may not be present in all instances.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the systems and methods have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application. Thus, the breadth and scope of the disclosure herein should not be limited by any of the above descriptions. Rather, the scope of the invention should be defined in accordance with the following claims and their equivalents.

I claim:

1. An antenna reflector with a deployable perimeter, comprising:

a reflector surface which forms a predetermined dish-like shape and has a main dish axis;

the reflector surface comprised of an inner section which radially extends a first predetermined distance L1 from the main dish axis, the inner section immovably supported on a fixed backing structure, and an outer section comprising a deployable perimeter; and a deployable support structure configured to movably support at least a portion of the outer section, the deployable support structure comprised of a plurality of rib tips hingedly secured to the fixed backing structure, each having an elongated shape, and extending in a direction away from the main dish axis;

wherein the rib tips are configured to rotate on hinge members relative to the fixed backing structure from a first position in which the reflector antenna is made more compact for stowage, to a second position in which a diameter of the reflector surface is increased at a time of deployment.

2. The antenna reflector according to claim 1, wherein the outer section extends a second predetermined distance L2 from an outer periphery of the inner section when the rib tips are in the second position and a magnitude of L2 is a value between 0.5*L1 and 4*L1.

3. The antenna reflector according to claim 1, wherein the inner section is comprised of a pliant RF reflector material which is conformed to the dish-like shape by the fixed backing structure.

4. The antenna reflector according to claim 3, wherein the outer section is comprised of the pliant RF reflector material, and is conformed to the dish-like shape by the deployable support structure.

5. The antenna system according to claim 4, wherein the inner section and the outer section are formed of a single continuous sheet of the pliant RF reflector material.

6. The antenna system according to claim 4, wherein the pliant RF reflector material is a conductive metal mesh.

7. The antenna system according to claim 2, wherein at least a portion of the outer section is supported on a plurality of elongated support elements which extend from the fixed backing structure in radial directions relative to the main dish axis, and are immovable relative to the fixed backing structure.

8. The antenna system according to claim 1, wherein the fixed backing structure is comprised of a plurality of elongated ribs, each formed of a rigid material and extending in a radial direction relative to the main dish axis.

9. The antenna system according to claim 1, wherein each of the rib tips in the first position is rotated so that a tip end of each rib tip is pointed toward the dish main axis.

10. The antenna system according to claim 1, wherein the rib tips in the first position are substantially aligned with the main dish axis.

11. The antenna system according to claim 1, wherein a network of cords is used to shape at least one of the inner section and the outer section.

12. The antenna system according to claim 1, wherein the plurality of rib tips are comprised of adjacent rib tip pairs which rotate respectively on first and second hinges and extend to distal rib tip ends, wherein the first and second hinges are configured to cause a distance between the distal rib tip ends to increase as the rib tips are rotated on the first and second hinges from the first position to the second position.

13. The antenna system according to claim 12, wherein a distance between the distal rib tip ends of a first rib tip of a first adjacent rib tip pair and a third rib tip of a second adjacent rib tip pair is decreased as the rib tips move from the first position to the second position.

14. The antenna system according to claim 2, wherein a magnitude of L2 is a value between L1 and 3*L1.

15. The antenna system according to claim 1, further comprising at least one spring member provided for each rib tip and configured to exert a bias force on the rib tip which is configured urge the rib tip to rotate about the hinge member from the first position to the second position.

16. The antenna system according to claim 15, further comprising a retention mechanism for releasably securing the rib tips in the first position.

17. An antenna reflector with a deployable perimeter, comprising:

a reflector surface which forms a predetermined dish-like shape and has a main dish axis;

the reflector surface comprised of an inner section which radially extends a first predetermined distance L1 from the main dish axis, the inner section immovably supported on a fixed backing structure, and an outer section comprising a deployable perimeter; and a deployable support structure configured to movably support at least a portion of the outer section, the deployable support structure comprised of a plurality of rib tips hingedly secured to the fixed backing structure, each having an elongated shape, and extending in a direction away from the main dish axis;

wherein the rib tips are configured to rotate on hinge members relative to the fixed backing structure from a first position in which the reflector antenna is made more compact for stowage, to a second position in which a diameter of the reflector surface is increased at a time of deployment, and the outer section extends a second predetermined distance L2 from an outer periphery of the inner section when the rib tips are in the second position and a magnitude of L2 is a value between L1 and 2*L1.

18. The antenna reflector according to claim 17, wherein the inner section is comprised of a pliant RF reflector material which is conformed to the dish-like shape by the fixed backing structure.

19. The antenna reflector according to claim 18, wherein the outer section is comprised of the pliant RF reflector material, and is conformed to the dish-like shape by the deployable support structure.

20. The antenna system according to claim 19, wherein the inner section and the outer section are formed of a single continuous sheet of the pliant RF reflector material.

* * * * *